United States Patent [19]

Boisseau

[11] Patent Number: 5,063,726

[45] Date of Patent: Nov. 12, 1991

[54] METHOD AND DEVICE FOR FORMING, CLOSING AND RECIPROCALLY FASTENING THE FLAPS OF A BOX SUCH AS AN AMERICAN CARDBOARD BOX

[75] Inventor: Jean-Louis Boisseau, Bucheres, France

[73] Assignee: Vega Automation, France

[21] Appl. No.: 591,873

[22] Filed: Oct. 2, 1990

[30] Foreign Application Priority Data

Oct. 2, 1989 [FR] France ..... 89 12835

[51] Int. Cl.[5] ..... B65B 7/20; B65B 51/02

[52] U.S. Cl. ..... 53/491; 53/376.5; 53/377.4; 53/387.1

[58] Field of Search ..... 53/566, 374, 375, 381 R, 53/383, 387, 458, 491, 376.5, 377.4, 387.1; 493/316, 245

[56] References Cited

U.S. PATENT DOCUMENTS

| | | | |
|---|---|---|---|
| 2,280,773 | 4/1942 | Ferguson . | |
| 2,419,991 | 5/1947 | Dunning | 53/491 |
| 2,435,878 | 2/1948 | Dunning | 53/374 X |
| 2,485,040 | 10/1949 | Cupo | 53/387 X |
| 2,496,336 | 2/1950 | Cupo | 53/491 X |
| 2,714,792 | 8/1955 | Wright et al. | 53/374 X |
| 3,253,389 | 5/1966 | Miller et al. | 53/491 X |
| 3,411,695 | 11/1968 | Cupo | 53/491 X |
| 3,465,490 | 9/1969 | Mahncke . | |
| 3,665,674 | 5/1972 | Bivans et al. | 53/374 X |
| 3,747,482 | 7/1973 | Berney | 53/566 X |
| 4,160,406 | 7/1979 | Nowacki . | |
| 4,163,414 | 8/1979 | Bachman, Jr. et al. . | |
| 4,541,888 | 9/1985 | Marchetti . | |
| 4,807,428 | 2/1989 | Boisseau . | |
| 4,964,260 | 10/1990 | Focke et al. | 53/491 X |

FOREIGN PATENT DOCUMENTS

| | | |
|---|---|---|
| 0248700 | 12/1987 | European Pat. Off. . |
| 2029300 | 10/1970 | France . |
| 2272900 | 12/1975 | France . |
| 2429154 | 1/1980 | France . |
| 2405873 | 5/1984 | France . |
| 2523549 | 10/1987 | France . |

*Primary Examiner*—Horace M. Culver

*Attorney, Agent, or Firm*—Hill, Van Santen, Steadman & Simpson

[57] ABSTRACT

Method for forming, closing and fastening the flaps of a box, comprising the stages in which the internal flaps (5) are brought into their final position, glue (19) is deposited on fastening zones of the flaps (5, 6); the external flaps (6) are brought into their final position; when the glued fastening zones are in reciprocal contact, a force is exerted on the two pairs of flaps (5, 6) which is appropriate to stress them towards one another and to maintain the fixed contact between the reciprocal fastening zones for the period required for the appropriate setting of the glue, characterized in that the pair of external flaps (6) are locked in pivoting in their final position and the pair of internal flaps (5) are stressed, by suction, from the outside of the box (1), through the slot-shaped passage (20) limited by the two opposite free edges (11) of the pair of external flaps (6).

41 Claims, 8 Drawing Sheets

METHOD AND DEVICE FOR FORMING, CLOSING AND RECIPROCALLY FASTENING THE FLAPS OF A BOX SUCH AS AN AMERICAN CARDBOARD BOX

The invention relates to a method and a device for forming, closing and reciprocally fastening the flaps of a box such as an American cardboard box, or alternatively an American/Dutch half-box.

A boxing machine for American boxes is already known (document U.S. Pat. No. 4,807,428 and machine called "FLEXILINE" from the company VEGA AUTOMATION) of the type comprising means for supplying empty boxes, on which means are placed, from upstream to downstream, on the one hand a store of box blanks folded flat and stacked and, on the other hand, means for opening, filling out the box and forming its bottom by folding and fastening the flaps which make it up; means for supplying the contents of the box in batches capable of being boxed; means for transferring the batches of the contents with a view to placing them in the open boxes prepared for this purpose, which means are placed in between the downstream end parts of the means for supplying empty boxes and contents; and means for removing the boxes, on which means are placed, from upstream to downstream, on the one hand the abovementioned transfer means and, on the other hand, means for forming the lid by folding and fastening the flaps which make it up, in which machine the opening, filling-out and bottom-forming means and the means for forming the lid are mounted so as to slide but are capable of being locked on shafts and are displaced along these shafts by drive means permanently integrated into the machine and associated with numerical control means, the constituent means of the machine being capable of being displaced at least partially simultaneously.

In the abovementioned known embodiment, there are provided two horizontal, lateral beams which can move horizontally and transversely but are capable of being locked and adjusted and extend parallel to and on either side of the box-feeding means and are provided with internally threaded bearings; at least two threaded rods interacting with the internally threaded bearings; bearings for the threaded rods; at least one motor for driving the threaded rods via a chain or a similar member, which motor is controlled by the control means. The first beam supports, from upstream to downstream, two pivoting arms whose function is to fold two flaps of the bottom, means for gluing the first folded flaps and means whose function is to fold the second flaps. The second beam supports, opposite the said means, movable means forming a backing for the first flaps inside the box. These means forming a backing consist of a plurality of juxtaposed jacks, arranged in a matrix having at least one line and at least one column, each of the jacks having a basic backing plate, the jacks being controlled by the control means such that some of the jacks are active, namely those whose basic plates, forming a backing, can penetrate inside the box in question. The matrix of jacks is defined by the largest format of boxes to be treated.

The prior art is also illustrated by the following documents: the document FR-2,272,900 relates to the forming of a tray by means of pivoting levers acting on corresponding elements of the blank forming the tray. The document FR-2,429,154 relates to the development and closing of a folded cardboard blank. The document FR-2,523,549 relates to the sealing of cardboard boxes and provides pressing means such as loose-running rollers which can move between the distanced and close positions and are capable of exerting pressure on the sides of the box in opposite directions. The document FR-2,273,715 relates to the folding, with a view to the assembly, of cardboard packaging trays comprising means for folding back the flaps towards the inside. The document FR-2,405,873 relates to the folding of the internal flaps of a cardboard box. The document FR-2,029,300 provides for pressure to be applied to the top of the opening of a cardboard box filled with its contents, the flaps having been glued beforehand. The documents U.S. Pat. Nos. 2,280,773 and 4,163,414 illustrate mechanical means intended to fold the flaps of cardboard boxes.

The prior art is also illustrated by the document U.S. Pat. No. 3,465,490.

Such boxing machines therefore comprise, combined with other members, components, subassemblies and devices, a device for forming, closing and reciprocally fastening the flaps of an American box (or any other equivalent box, this specification not being systematically repeated hereinafter), this device comprising box-support and -drive means; means for bringing the internal flaps at least substantially into their final position, such as arms; means for gluing the two fastening zones; means for bringing the external flaps at least substantially into their final position, such as movable arms; and means for temporarily exerting on the two pairs of flaps a force which is appropriate to stress them towards one another and to maintain the fixed contact between the reciprocal fastening zones for the period required for the appropriate setting of the glue. A device of this type is employed by a method comprising stages in which the internal flaps are brought at least substantially into their final position, glue is deposited on fastening zones of the flaps; the external flaps are brought at least substantially into their final position; when the glued fastening zones are in reciprocal contact, a force is temporarily exerted on the two pairs of flaps which is appropriate to stress them towards one another and to maintain the fixed contact between the reciprocal fastening zones for the period required for the appropriate setting of the glue.

If reference is made to the prior art in which the means forming a backing and which are necessary for the closing of the bottom of the box, at this time substantially empty, consist of a plate—or an equivalent element—(as a single piece or as several small basic plates) carried by one or a plurality of jacks—or equivalent elements—so as to be able to be engaged in the box, inside it, against the bottom, several problems or limitations have been encountered.

Firstly, the size of the plates must always be at most equal (to within strict tolerances) to the internal size of the box as it would otherwise be impossible for the plate to penetrate and remain inside the latter.

Secondly, there must be no elements, members, pieces, raised parts, etc. present in the box likely to hinder the movement of the plate when it is introduced.

Thirdly, the rates remain limited, given the large travel which the plate must make.

SUMMARY OF THE INVENTION

The object of the invention is to overcome these various problems. It is therefore aimed at permitting the forming, closing and reciprocal fastening of a box with flaps, such as an American box, at an increased rate whilst being able, in a certain manner and with certain embodiments, to free oneself from the obligation of having a plate with a size at most equal to the internal size of the box. Taking into account the means employed, the invention can equally well be applied to the bottom as to the lid of the box.

To this end, the invention provides a method of the abovementioned type such that, in order to exert temporarily on the two pairs of flaps a force appropriate to stress them towards one another, the pair of external flaps are locked in pivoting in their final position in order to prevent them from tending to return towards their initial position; and the pair of internal flaps are stressed, by suction, from the outside of the box, through the slot-shaped passage limited by the two opposite free edges of the pair of external flaps, which causes the internal flaps to be applied and locked against the external flaps. A device, for implementing the method, of the abovementioned type is such that the means comprise, on the one hand, a suction member which can be displaced between a distal position and a proximal position, is capable of being, in the proximal position, in the active state, and is situated in the vicinity of the means and hence outside the box, and, on the other hand, combined with the suction member, support and drive means, means for creating a reduced pressure communicating with the suction member, and control means.

BRIEF DESCRIPTION OF THE DRAWINGS

The other features of the invention will emerge from the description below made with reference to the attached drawings, in which.

DESCRIPTION OF THE PREFERRED EMBODIMENTS

Figure 2A:
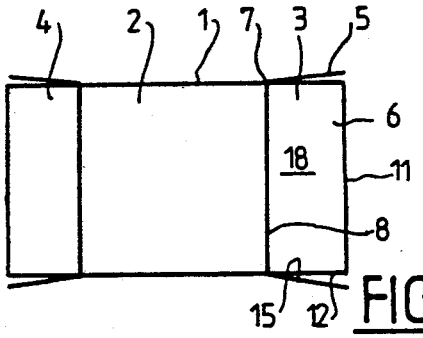
FIGS. 2A, 2B, 2C, 2D, 2E and 2F are six diagrammatic plan views of an American box in different stages of implementation of the method using the device according to the invention.

The invention relates to a method for forming, closing and reciprocally fastening the flaps of a box 1 such as an American cardboard box, but equally well to an American half-box or a Dutch box, and more generally to any other similar box. Such a box comprises four side walls and a bottom 3 and a lid 4. The bottom 3 or the lid 4 is of the type comprising a pair of internal flaps 5 and a pair of external flaps 6 associated with the adjoining side walls 2 so as to pivot about folding lines 7 and 8 respectively. Each internal flap 5 is limited by a folding line 7, a free parallel edge 9 and two side edges 10 joining them. An external flap 6 is limited by a folding line 8, a free parallel edge 11 and two side edges joining them 12.

The bottom 3 and the lid 4 preferably have the same general structure. The invention applies equally well to either one of them, the box being empty in the case of the closing of the bottom 3 and full in the case of the closing of the lid 4.

The American box 1 in question is preferably such that the external flaps 6 are joining, in other words their respective free edges 11 substantially join, and have non-joining internal flaps 5, in other words their respective free edges 9 are at a distance from one another, creating a space 13 between them. However, the invention could also be applied in the case of an American box in which all the flaps join. It could also be applied in the case where the external flaps 6 do not join.

Internal flaps 5 are understood to mean the flaps which are situated, when the bottom 3 or the lid 4 to which they belong is formed and closed, on the side of the internal volume 14 of the box 1, as opposed to the external flaps 6 which are opposite the internal volume 14 and cover the internal flaps 5.

Each internal flap 5 has an inner face 15 and an outer face 16 and each external flap 6 has an inner face 17 and an outer face 18. Inner face 15, 17 is understood to mean a face turned towards the internal volume 14 and outer face 16, 18 is understood to mean a face turned away from the internal volume 14 when the box 1 or the bottom 3 or lid 4 in question is closed.

Figure 1:
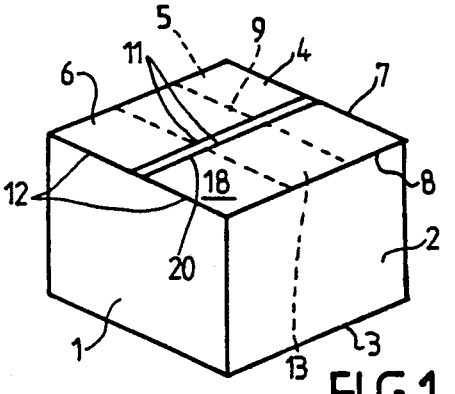
FIG. 1 is a diagrammatic perspective view of a closed American box permitting the implementation of the method and of the device according to the invention.

When the bottom 3 or lid 4 is formed and closed (FIG. 1), the flaps of each pair of flaps 5, 6 respectively are substantially coplanar and face one another. In addition, the two pairs of flaps 5, 6 are arranged transversely relative to one another, the free edges 9 and 11 being substantially perpendicular. Moreover, glue 19 rigidly combines fastening zones in contact belonging to the outer faces 16 of the internal flaps 5 and to the inner faces 17 of the external flaps 6, respectively. This glue 19 is in the form of points, lines or a surface in a manner known per se by a person skilled in the art. Such a box 1 as has just been described is generally known per se from the prior art and is described here only in order to enable the method and the device according to the invention to be readily understood. The method and the device according to the invention apply not only to an American box 1 as has just been described but to any packaging having a general structure of the same type, in other words comprising flaps such as 5, 6 mounted so as to be able to pivot relative to side walls 2 along folding lines 7, 8.

According to a common feature of American boxes 1 as have just been described, and of packagings of the same type, a slot-shaped passage limited by the two opposite joining free edges exists, even when the flaps are of the so-called joining type. This is, for example, the case with the American box 1 which has just been described with respect to the external flaps 6 whose free edges 11, although theoretically joining, leave between them a certain gap or passage 20. This gap or passage 20 results from the imperfections in the cutting of the corresponding free edges 11 and from a clearance provided for this purpose in order to prevent the flaps 6 from inadvertently covering one another. This clearance or passage 20 may have a transverse dimension of the order of a millimeter or less and where necessary up to a few millimeters or more.

The method and the device according to the invention are preferably used for the bottom 3 of the empty box 1 but they can also be employed for the lid 4 of the full box. The description therefore refers to both cases equally.

Figure 3A:
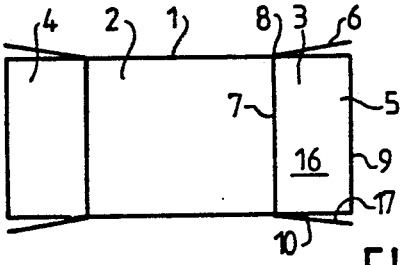
FIGS. 3A, 3B, 3C, 3D, 3E and 3F are six diagrammatic front and vertical views corresponding to FIGS. 2A to 2F.
Figure 4A:
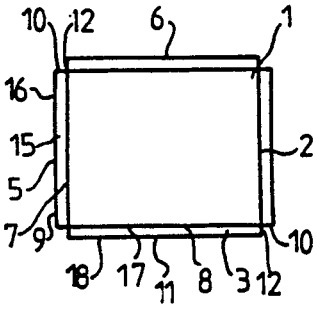
FIGS. 4A, 4B, 4C, 4D, 4E and 4F are six diagrammatic views in elevation of the bottom or the lid of the box in the operational stages shown in FIGS. 2A to 2F and 3A to 3F.
Figure 2B:
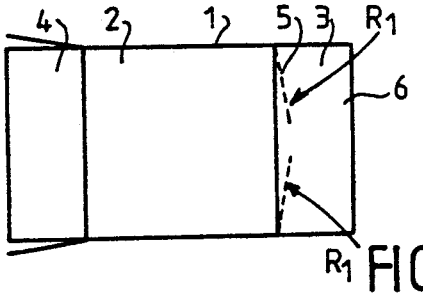
Figure 3B:
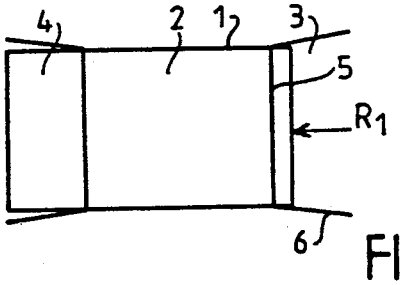
Figure 4B:
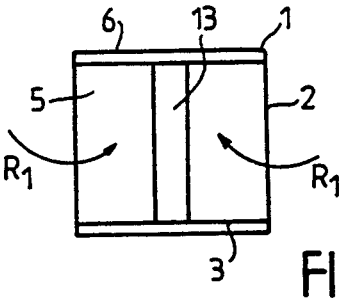
Figure 2C:
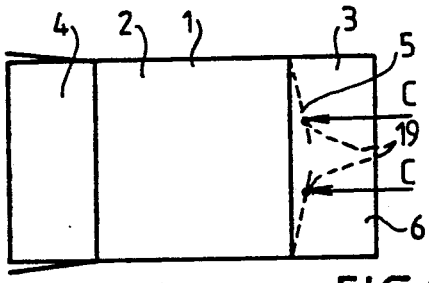
Figure 3C:
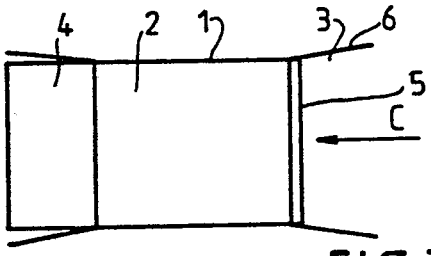
Figure 4C:
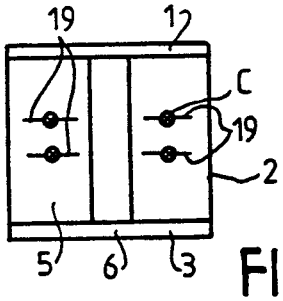
Figure 2D:
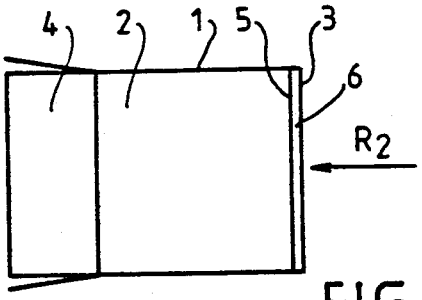
Figure 3D:
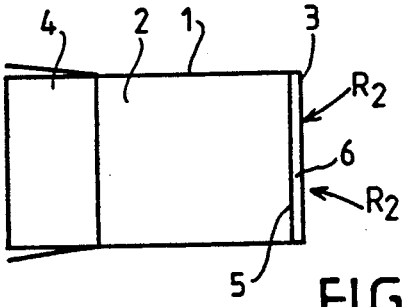
Figure 4D:
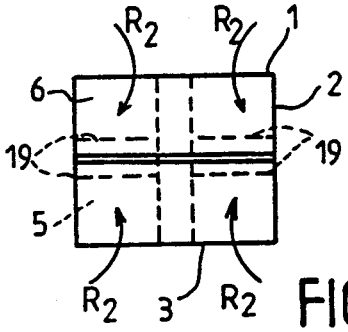

The description refers, with respect to the flaps 5 and 6, to initial and final positions. These positions are as follows: in their initial position (FIGS. 2A, 3A and 4A), the two internal flaps 5 are parallel to one another and at a distance from one another and the two external flaps 6 are parallel to one another and at a distance from one another. The internal flaps 5 and the external flaps 6 are extensions of the adjoining side walls 2 and the internal flaps 5 are substantially perpendicular to the external flaps 6. The flaps have been shown in the figures in their initial position, diverging slightly relative to the side walls 2 so as to make the drawings more clear. The final position of the flaps 5, 6 corresponds to that in which the bottom 3 or lid 4, respectively, is formed and closed. As has already been mentioned, the flaps of each pair of flaps 5, 6 are then substantially coplanar and facing, the two pairs of flaps being arranged transversely relative to one another (FIGS. 2D, 3D and 4D for the bottom 3).

The two flaps of each pair of flaps 5, 6 are independent of one another. However, they are generally arranged symmetrically to one another relative to a mid-plane of the box 1. In addition, they are generally displaced synchronously and in a same movement, symmetrically relative to the same mid-plane.

Figure 12:
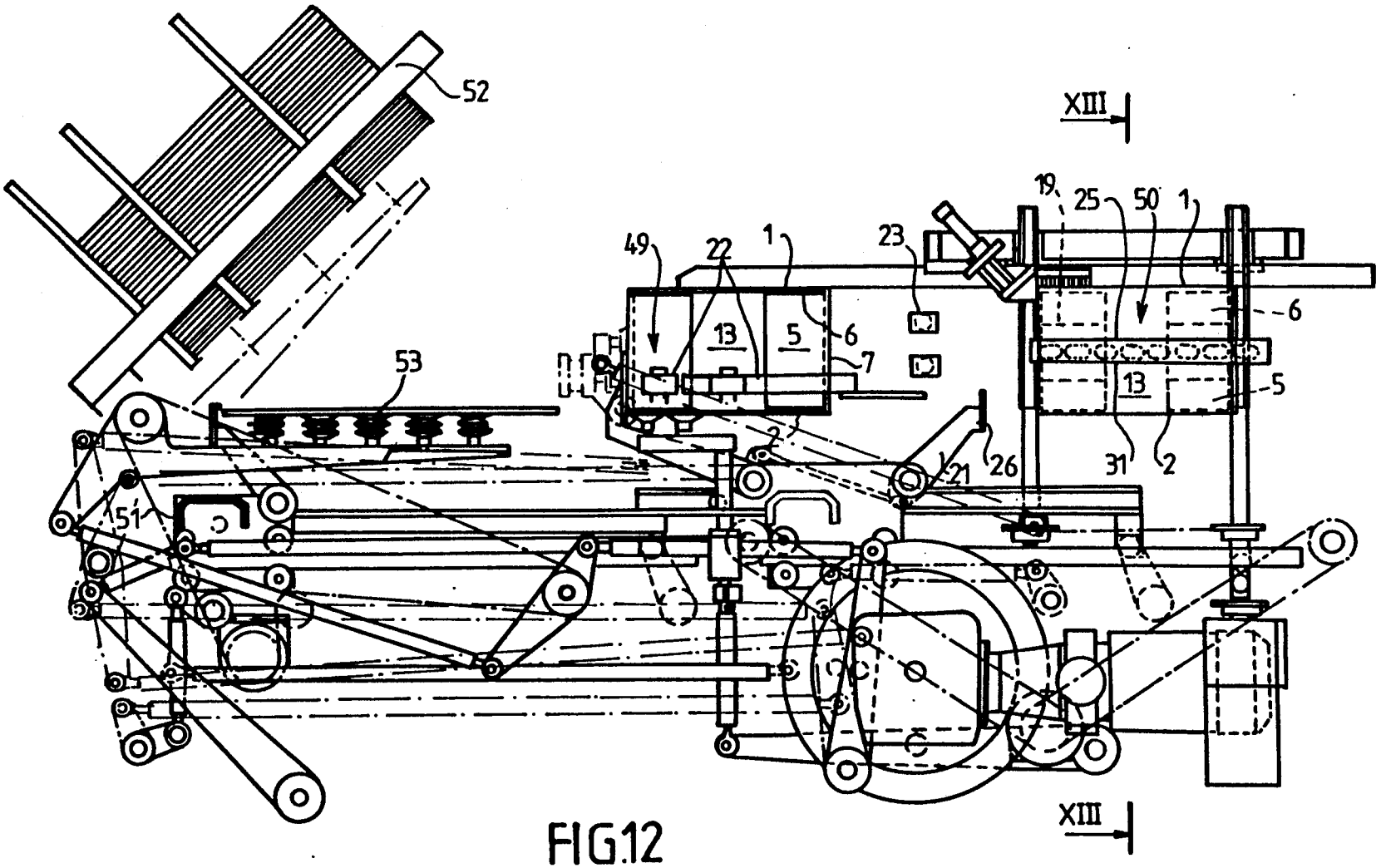
FIG. 12 is a diagrammatic view in cross-section through a longitudinal vertical plane of a boxing machine employing the device according to the invention.

Three mutually perpendicular directions are conventionally defined in space, namely a longitudinal direction and a transverse direction, both horizontal, and a vertical direction. A transverse plane is likewise conventionally defined as being any vertical plane parallel to the transverse direction, and a longitudinal plane any vertical plane parallel to the longitudinal direction. Lastly, a horizontal plane is parallel to the longitudinal and transverse directions. The method and the device of the invention are conventionally employed in the typical following case: the side walls 2 are situated in horizontal or transverse planes. The bottom 3 or lid 4, respectively, once formed and closed, are situated in two longitudinal mutually parallel planes at a distance from one another. The folding lines 7 of the internal flaps 5 have the vertical direction and the folding lines 8 of the external flaps 6 have the longitudinal direction. In their initial position, the internal flaps 5 extend substantially parallel to transverse planes, whereas the external flaps 6 extend substantially in horizontal planes in their initial position. Lastly, the passage 20 is situated in a longitudinal plane and extends along the longitudinal direction. Moreover, the method and the device according to the invention are preferably employed when the box 1 is displaced in the longitudinal direction. This displacement is either rectilinear (in the case of the machine according to FIG. 12) or circular (alternative machine, not shown, of the revolving type).

Figure 6:
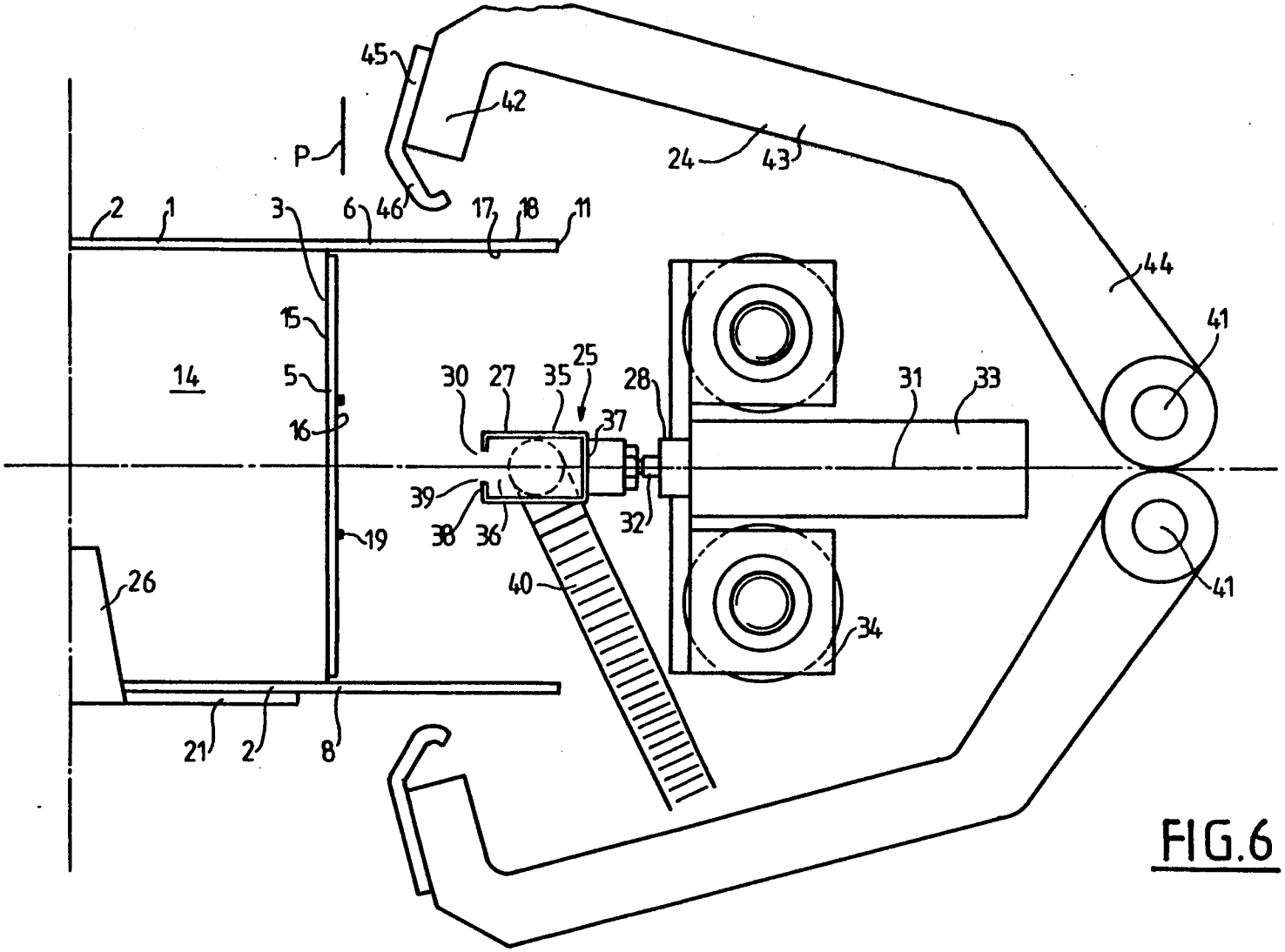
FIGS. 6 and 7 are two diagrammatic views in cross-section through a vertical front plane of the device according to the invention in the distal position or in the inactive state, and in the proximal position or in the active state, respectively.
Figure 13:
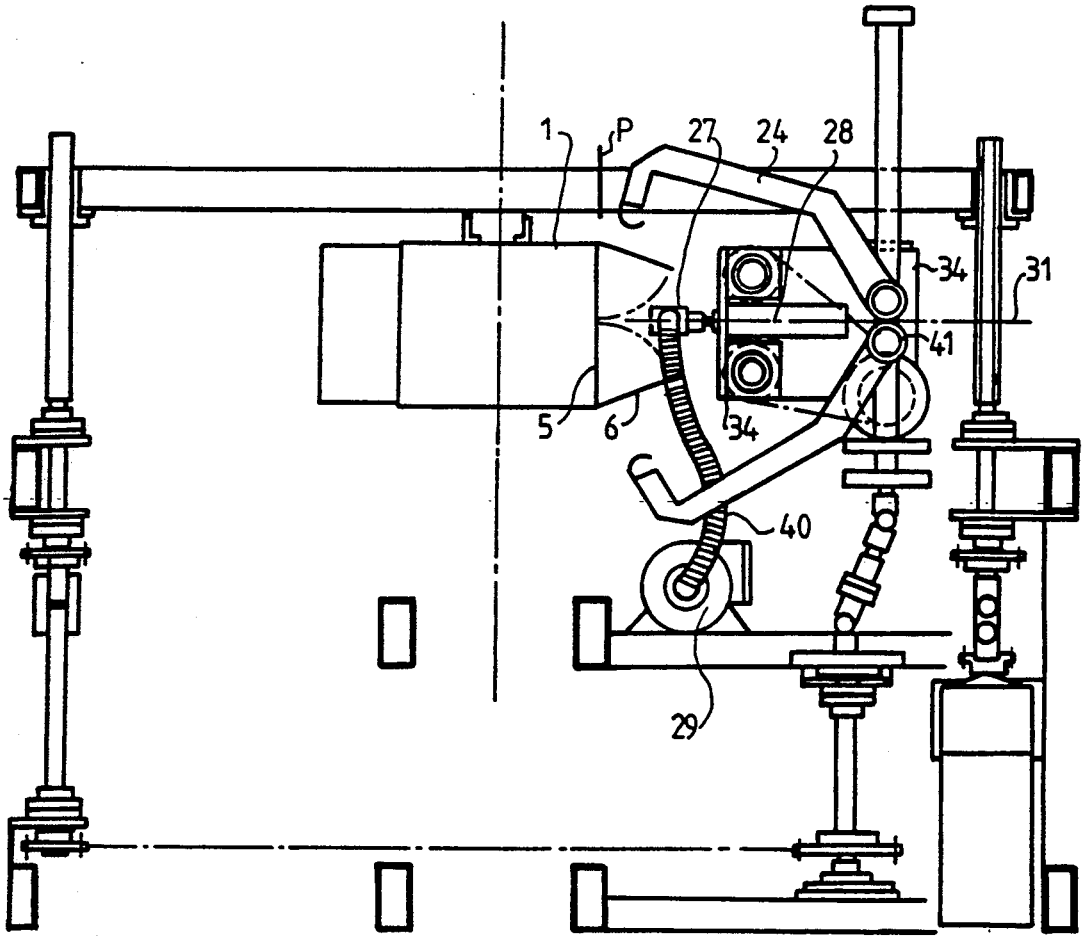
FIG. 13 is a partial diagrammatic view in cross-section through a vertical and transverse plane of the machine as shown in FIG. 12 along the line XIII—XIII in the latter.

The device according to the invention comprises, in a general manner, means 21 (FIGS. 6 and 12) for supporting and driving the box 1; and, from upstream to downstream, means 22 for bringing the internal flaps 5 at least substantially into their final position, such as arms; means 23 for gluing fastening zones of the faces 16, 17; means 24 (FIGS. 6 and 13) for bringing the external flaps 6 at least substantially into their final position, such as movable arms; and means 25 (FIGS. 6, 7 and 12) for temporarily exerting on the two pairs of flaps 5, 6 a force appropriate to stress them towards one another and to maintain the fixed contact between the reciprocal fastening zones for the period required for the appropriate setting of the glue 19.

The box-support and -drive means 21 consist, in the alternative machine shown, of a conveyor having grippers 26, this conveyor being arranged substantially horizontally, extending and being displaced so as to slide longitudinally, whereas the grippers 26 are directed vertically and upwards such that a box 1 rests and is driven by way of a horizontal side wall 2 resting on the conveyor and a vertical side wall 2 onto which the gripper 26 locks.

Taking into account the structure of the box 1, the means 22 can be defined as being means for folding the internal flaps 5, and the means 24 as means for folding the external flaps 6. Likewise, the means 25 can be qualified as means for applying reciprocal pressure to the internal 5 and external 6 flaps.

The method comprises successive stages in which the internal flaps are brought at least substantially into their final position by folding about the lines 7, by way of the means 22; glue 19 is deposited on fastening zones of the outer 16 and/or inner 17 faces; the external flaps 6 are brought at least substantially into their final position by folding about folding lines 8 by way of the means 24 and when the glued fastening zones are in reciprocal contact a force is temporarily exerted on the two pairs of flaps 5, 6 which is appropriate to stress them towards one another and to maintain the fixed contact of the reciprocal fastening zones for the period required for the appropriate setting of the glue 19, and this is effected by way of the means 25.

Figure 2E:
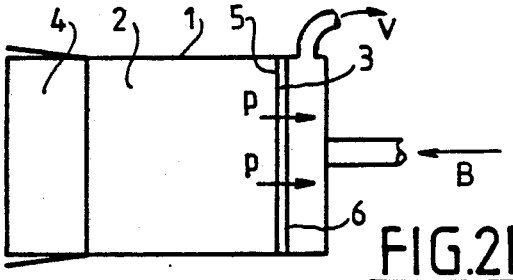
Figure 3E:
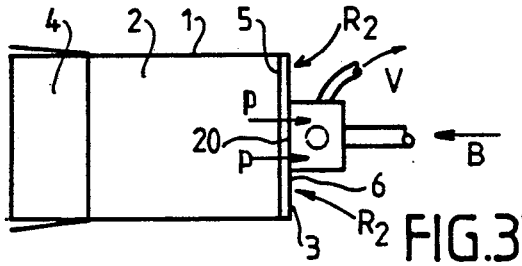
Figure 4E:
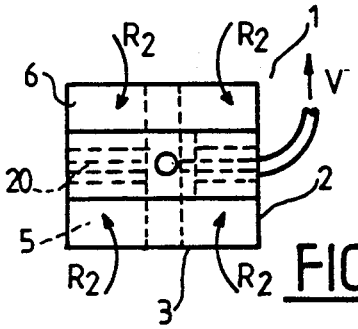

According to the invention and instead of reciprocal-pressure means such as those consisting of two plates placed against the formed bottom on either side, inside and outside the box 1, the device according to the invention comprises, firstly, a suction member 27 which can be displaced between a distal position (FIGS. 2F, 3F and 6) and a proximal position (FIGS. 2E, 3E and 7) and is capable of being, in the proximal position, in the active state (arrow V in FIGS. 2E, 3E and 4E). This suction member 27 is situated in the vicinity of the means 24 for folding the external flaps. The suction member 27 is therefore situated entirely and permanently outside the box 1, in other words outside its internal volume 14. The device comprises, secondly, associated with the suction member 27, means 28 for supporting and driving this suction member 27, means 29 for creating a reduced pressure communicating with the suction member 27 (FIG. 13), and control means, not shown. The means 29 for creating a reduced pressure and means for communication between the suction member 27 and the means 29 are both termed suction means in what follows and as a whole.

In the method according to the invention, in order to exert the desired reciprocal pressure on the flaps 5, 6, the pair of external flaps 6 are locked in pivoting in their final position in order to prevent them from tending to return towards their initial position (FIGS. 2D, 3D, 4D, 2E, 3E and 4E) by way of the means 24; and the pair of internal flaps 5 are stressed, by suction, from the outside of the box 1, through the passage 20, by way of the suction member 27 employed for this purpose. This causes the internal flaps 5 to be applied and locked against the external flaps 6 which are themselves locked in their final position (FIGS. 2F, 3F, 4F and 7).

The method according to the invention therefore employs the suction member 27. When the external flaps 6 are at least substantially in their final position, the suction member 27 is applied to the outer faces 18 of the external flaps 6, at least overlapping the passage 20 and facing the internal flaps 5 when they are in their final position. In this situation, the suction member 27 is active so as to create a reduced pressure on the side of the outer faces 16 of the internal flaps 5.

As will be seen later in detail, a suction member 27 is employed having a suction zone 30 which can be adjusted in the longitudinal direction along the passage 20 so as to be able to form, close and fasten boxes of variable format, in particular in the longitudinal direction.

The suction member 27 can be displaced between a distal position where it is at a distance from the bottom 3 or lid 4, respectively, so as not to interfere with the flaps 5, 6 irrespective of their position, and a proximal position where its suction zone 30 is substantially in the plane of the outer faces 18 of the external flaps 6 when they are in their final position. To this end, and for example, the suction member 27, supported and driven by the means 28, is mounted so as to slide along a transverse axis 31 perpendicular to the reference plane of the bottom 3 or lid 4, respectively. In what follows, reference plane P of the bottom 3 or lid 4, respectively, designates the plane defined essentially by the outer faces 18 of the external flaps 6. To this end, the support and drive means 28 can comprise a jack with axis 31 whose rod 32 is fixed to the suction member 27 and whose body 33 is carried by a frame 34 of the device.

The suction member 27 is preferably employed such that when locked in its proximal position it contributes at least to ensuring the locking in pivoting of the pair of external flaps 6 in order to prevent their return towards their initial position. The suction member 27 is displaced slidingly along the axis 31 between these distal and proximal positions.

It is, of course, understood that the stages of the method can be modified in the case, for example, of a machine of the revolving type.

Preferably, and for industrial reasons, the suction member 27 can be either in an active state in which the suction is effective or in an inactive state where the suction has no effect. Moreover, the control means preferably control the suction member 27 such that the latter is in the active state in and only in its proximal position.

Figure 2F:
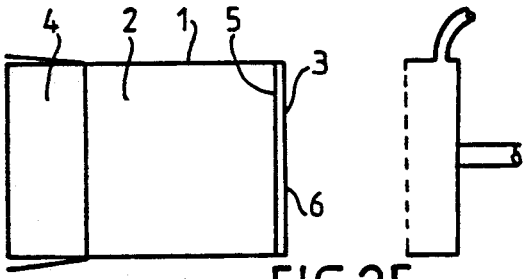
Figure 3F:
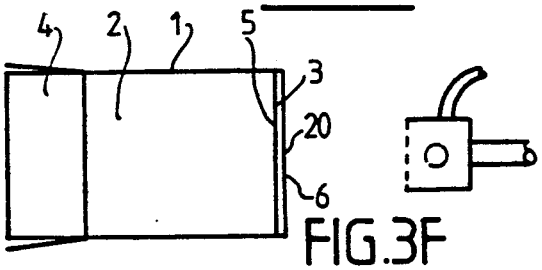
Figure 4F:
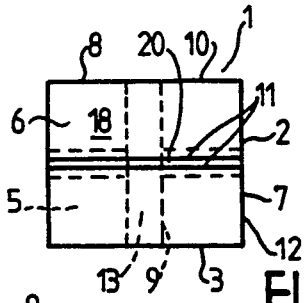
Figure 5:
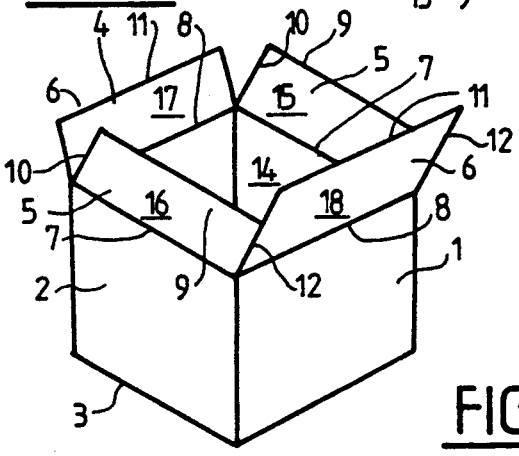
FIG. 5 is a diagrammatic perspective view of the American box employed in the method and the device according to the invention with the bottom or the lid open.

In a possible form of implementation of the method according to the invention, the various following stages are performed, successively: an open box 1 is supplied whose flaps 5, 6 are substantially in the extension of the side walls 2. One generally begins by forming and closing the bottom 3 and then, when the latter is formed and closed, the box 1 is filled with its contents and, lastly, the lid 4 is closed and fastened. For the bottom 3 or the lid 4, respectively, the pair of internal flaps 5 are then brought, by folding towards the inside, at least substantially into their final position. This stage is shown by the arrows R1 in FIGS. 2B, 3B and 4B. Glue is deposited on the outer faces 16 of the internal flaps 5. This stage is shown by the arrows C in FIGS. 2C, 3C and 4C. As has already been mentioned, the glue 19 is deposited in points, lines or as a surface. The glue is preferably deposited in the mid-zones of the internal flaps 5, in other words the near zone at right angles to the passage 20. The pair of external flaps 6 are immediately afterwards brought, by folding towards the inside, at least substantially into their final position, the suction member 27 being in its distal position. This stage is illustrated by the arrows R2 in FIGS. 2D, 3D and 4D. The suction member 27 is then brought into its proximal position. In its proximal position, the suction member is in the active state. This is illustrated by FIGS. 2E, 3E and 4E in which the arrows B indicate the locking pressure of the suction member 27, the arrows V illustrate the suction leaving the suction member 27 and the arrows p the pressure exerted perpendicular to the plane P by means of the suction member 27 on the internal flaps 5 in the direction stressing them towards and against the external flaps 6. Once the glue 19 has set appropriately, the suction member 27 is brought into its distal position. This stage is shown by FIGS. 2F, 3F and 4F. The box can then be removed, the bottom 3 or the lid 4, respectively, of which is formed, closed and fastened.

Figure 7:
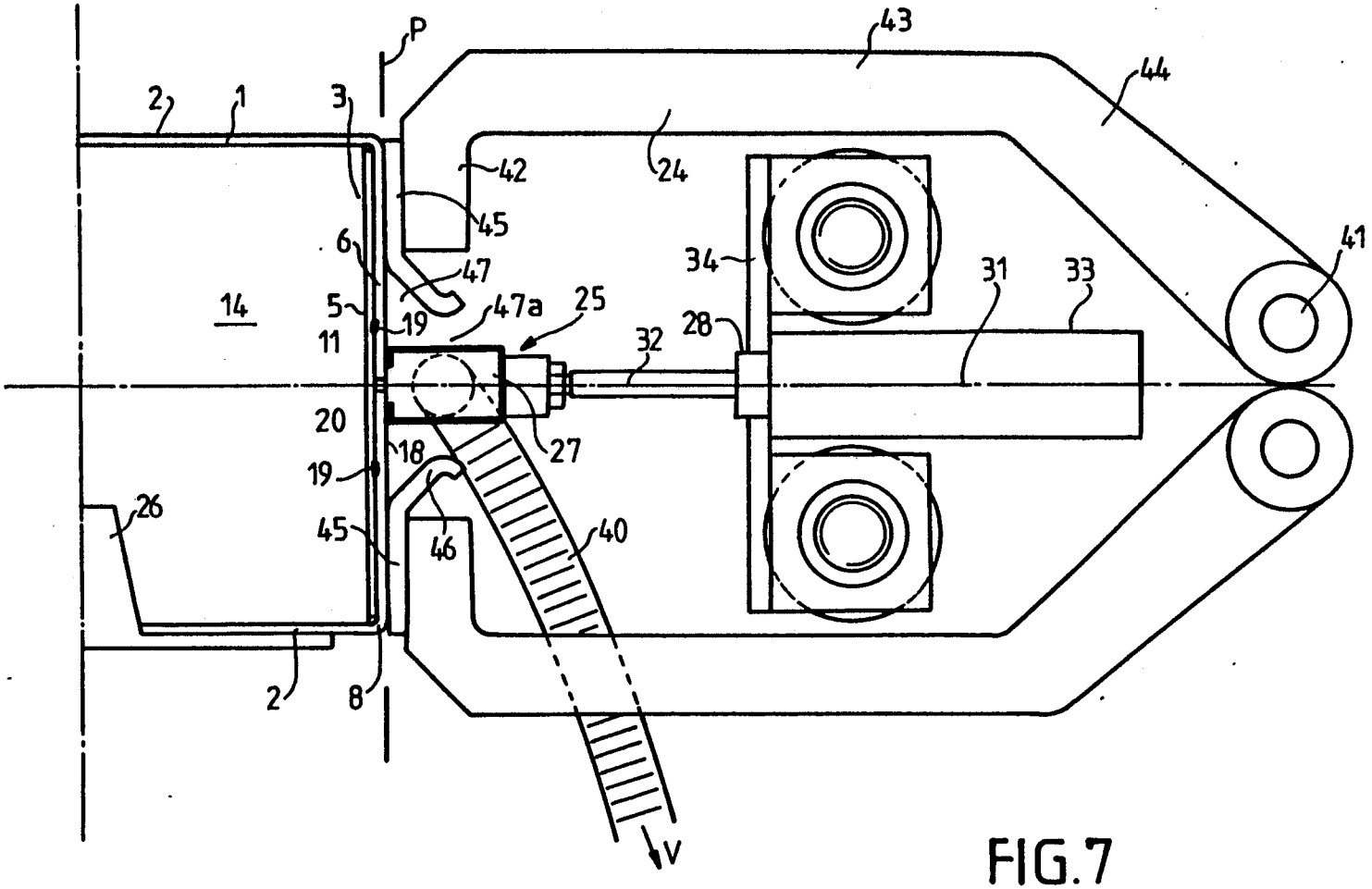

In order to bring the pair of external flaps 6 substantially into their final position, folding arms 24 for these flaps are preferably employed which can move and are each displaced from an inactive distal position (FIG. 6) into an active proximal position (FIG. 7). Moreover, the folding arms 24 are preferably employed when they are in their active proximal position so as to at least contribute towards ensuring the locking in pivoting of the pair of external flaps 6. In fact, the action of the folding arms 24 and of the suction member 27 are combined in order to lock the external flaps 6 in pivoting about their folding lines 8. The folding arms 24 ensure the locking approximately in the vicinity of the folding lines 8, whereas the suction member 27 ensures the locking approximately in the vicinity of the free edges 11.

Preferably, and for industrial reasons of implementation of the invention, the suction member 27 is brought from its proximal position into its distal position and the folding arms from their active proximal position into their inactive distal position at least substantially simultaneously.

The suction member 27 can, in one possible embodiment, be in the form of a hollow rectangular section, flattened in the vertical direction and elongated in the longitudinal direction. Such a hollow rectangular section is limited, for example, by two horizontal walls 35 at a distance from one another in the vertical direction, two transverse end walls 36, a longitudinal rear wall 37 and a longitudinal front wall 38. The jack rod 32 is fixed, for example, to the rear longitudinal wall 37. The front longitudinal wall 38 is pierced with suction orifices 39 defining, in combination, the suction zone 30.

The suction means 29 are preferably fixed and, carried by the frame 34 and are connected to the hollow rectangular section of the suction member 27 by a flexible pipe 40. This flexible pipe 40 can open out, for example, in one or both transverse walls 36. If necessary, means such as deflectors are provided inside the hollow rectangular section which are capable of ensuring an appropriate distribution of the suction over the entire desired length of the suction zone 30.

The suction means 29 consist, for example, of a vacuum pump, a suction turbine or a venturi or equivalent device.

In a possible alternative embodiment, the suction is uniform through the various suction orifices 39. In another alternative, it is stronger for certain suction orifices 39 and less strong for others. In particular, it is possible for a more substantial suction to be provided in the central part of the bottom 3 or lid 4, closest to the free edges 9 and furthest from the folding lines 8 and, vice versa, for a weaker suction to be provided in the proximity of the folding lines 8. To this end, the hollow rectangular section forming the suction member 27 can be fitted with members for adjusting the suction flow inside it, or alternatively the suction orifices 39 can have different surface areas.

If necessary, an elastically deformable airtight seal, such as a seal in the form of a flange made from an elastic plastic material, is provided around the front longitudinal wall 38 and/or around the suction orifices 39.

The suction member 27 can be formed, instead of from a single hollow rectangular section, from a multiplicity of basic suction cups aligned longitudinally.

The means 24 for bringing the external flaps 6 at least substantially into their final position preferably comprise, as mentioned, folding arms which can each move between an inactive distal position (FIG. 6) and an active proximal position. These arms are preferably mounted so as to pivot about longitudinal pivoting spindles 41. The folding arms 24 preferably comprise pressing bent-back parts 42 intended to be applied to the outer faces 18 when they are in their final position. These pressing bent-back parts 42 define—when the arms 24 are in their active proximal position—the reference plane P. Moreover, the outer face of the pressing bent-back parts 42 and the suction zone 30, when the folding arms 24 are in the active proximal position and the suction member 27 in the proximal position, are substantially coplanar, in the reference plane P, as can be clearly seen in FIG. 7.

A folding arm 24 has, in a transverse plane, a general back-to-front pseudo L-shape comprising a main part 43 forming a distance piece supporting, at one of its end parts, a pressing bent-back part 42 directed substantially perpendicularly, and whose other end part 44 is inclined on the main part 43 or curved inwards and is mounted so as to pivot on the frame 34 about spindles 41. In addition, a pressing bent-back part 42 comprises a main part 45 and at least one flange 46 inclined on the main part 45 or curved inwards in the same relative direction as the main part 43 of the arm 24. Moreover, two folding arms 24 are preferably provided arranged so as to be opposite one another such that their main parts 43 are at a distance from one another in the vertical direction, their end parts 44 directed towards one another in the direction of a horizontal plane passing through the axis 31. The pivoting spindles 41 are close to one another (as in the figure) or even coincide. The pressing bent-back parts 42 are substantially directed towards one another. With such a structure, the two folding arms 24 define a central free space 47 in which the suction member 27 and the support and drive means 28 are at least partially housed. Moreover, the pressing bent-back parts 42, in particular their flanges 46, are reciprocally spaced apart, in particular when the arms 24 are in their active proximal folding position, which enables a passage 47*a* to be created between them which forms part of the free space 47, in which passage 47*a* the suction member 27 can be housed and displaced slidably.

Figure 8:
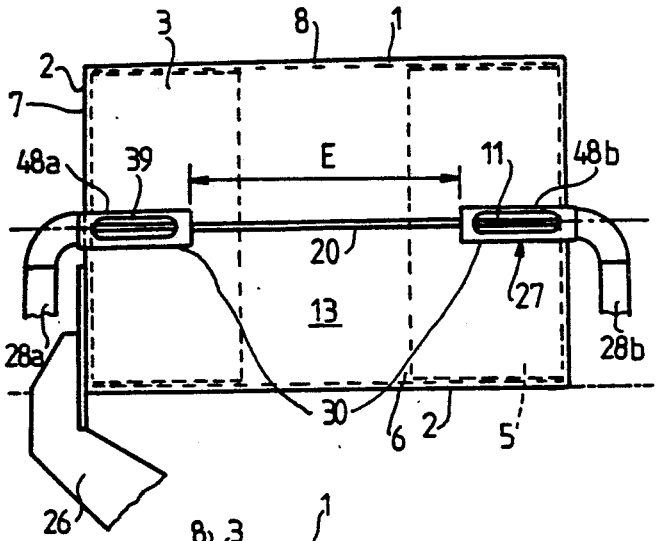
FIGS. 8 and 9 are two diagrammatic views in elevation with respect to a longitudinal vertical plane of a first alternative embodiment of the device according to the invention.
Figure 9:
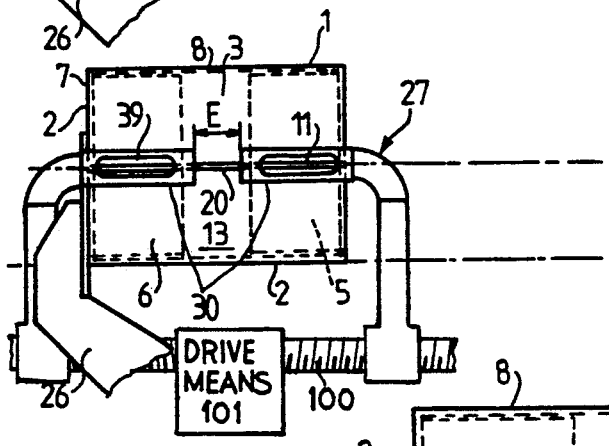

According to a feature of the invention, which is preferred but optional, the suction zone 30 of the suction member 27 can be adjusted in the longitudinal direction, in other words its length can be adjusted, which enables boxes of different formats, in particular of more or less large longitudinal dimensions, to be formed, closed and fastened. The form of such a suction member 27 with a suction zone 30 which can be adjusted in the longitudinal direction may form the subject of several alternative embodiments. Reference will now be made to FIGS. 8 and 9 which show a first possible alternative embodiment. In this case, the suction member 27 is in two parts 48*a*, 48*b* separate from one another and carried by separate support means 28*a*, 28*b*. The two parts 48*a*, 48*b* each have a limited dimension in the longitudinal direction and the spacing between them—that is E—can vary between a maximum value (FIG. 8) and a minimum value, which may be zero (FIG. 9), corresponding to boxes 1 of maximum and minimum format, respectively, in the longitudinal direction. The two parts 48*a*, 48*b* can each have the above-described structure and for this reason have not been further described. For example, each of the parts 48*a*, 48*b* can have a single suction orifice 39 on its longitudinal front wall 38. Spacing-adjustment means, not shown, enable the two parts 48*a*, 48*b* to be adjusted and locked in any position so as to adjust the longitudinal spacing between them. For example, the two parts 48*a*, 48*b* are carried by two arms mounted on a threaded longitudinal shaft 100 (see FIG. 9) arranged such that the rotation of this threaded shaft 100 in a same direction causes the two arms to slide in two directions opposite to one another. A motor or geared motor forms drive means 101 for rotating the threaded shaft.

In another alternative, not shown, the suction member 27 is in at least two parts forming a unit which is telescopic by sliding, and can be adjusted and locked in any position by way of spacing-adjustment means.

Figure 10:
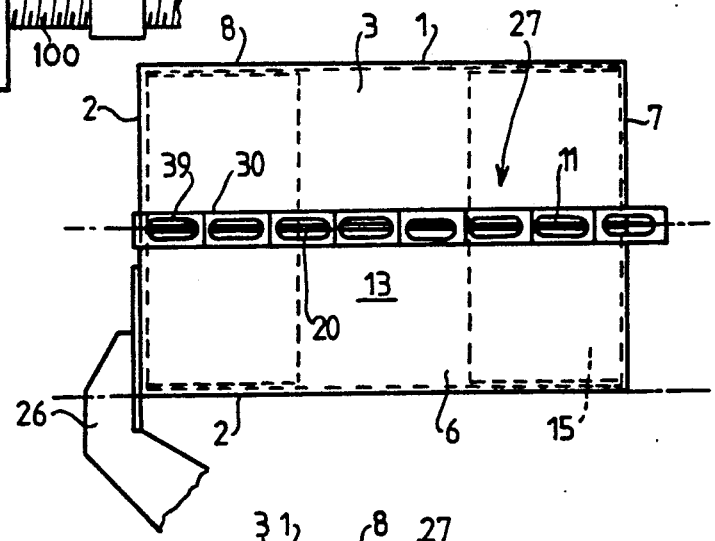
FIGS. 10 and 11 are two diagrammatic views in elevation with respect to a longitudinal vertical plane of a second alternative embodiment of the device according to the invention.
Figure 11:
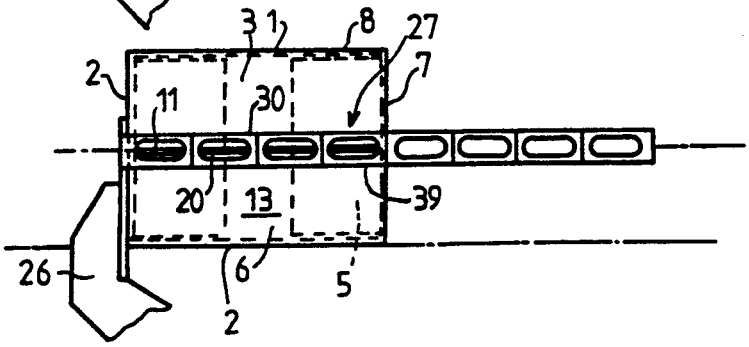

In another alternative illustrated in FIGS. 10 and 11, the suction member 27 comprises a plurality of suction orifices extending longitudinally and placed one after the other, the suction member 27 having a fixed length in the longitudinal direction. Means are then also provided for selectively activating some or all of the suction orifices 39. In a first alternative sub-embodiment, the means for selectively activating the suction orifices 39 comprise means for selectively opening or closing the orifices 39. Flaps are, for example, provided which can be opened and closed and this is done for each orifice 39 respectively. In another sub-alternative, the means for selectively activating the orifices 39 function pneumatically and not mechanically and selectively ensure the suction through the desired orifices 39. A multi-distribution may then exist for each of the suction orifices 39, appropriate selection means enabling this or that distribution to be activated or, on the contrary, rendered inactive.

The unit formed by the suction member 27, the folding arms 24 and the associated means is carried by the frame 34 which is situated in its entirety on a same side of the conveyor forming the support and drive means 21. If necessary and depending on the envisaged embodiment, this unit—and hence the frame 34—is fixed as a whole relative to the conveyor 21, in the transverse direction. In another alternative embodiment, intended more specifically for a flexible machine adapted to boxes 1 of variable format, the frame 34 can be displaced so as to slide transversely such that the proximal position of the suction member 27 is coplanar with the reference plane P, as has been mentioned.

The device preferably comprises two successive separate stations along the length of the conveyor 21, namely an upstream station 49 consisting of the arms 22 for folding the internal flaps and the gluing means 23, and a downstream post 50 consisting of the means 24 for folding the external flaps and the reciprocal pressure means 25.

Lastly, the invention relates to a machine for boxing American boxes, comprising a device such as that which has just been described or enabling the likewise described method to be implemented. This machine is, in particular, of the type described in the document U.S. Pat. No. 4,807,428. For this reason, this machine is not described in detail here. Instead of having, as in the document U.S. Pat. No. 4,807,428, reciprocal pressure means comprising an external plate and basic small plates forming a backing and mounted at the end of jack rods so as to be placed inside the box 1 in its internal volume 14, the machine according to the invention has the device which has just been described. Such a machine comprises a frame 51, the means 21 for supporting and driving the boxes, such as a conveyor with grippers, a store 52 of box blanks folded flat and stacked, situated at the upstream end part of the gripper conveyor 21, means 53 for transferring a blank from the store 52 onto the conveyor 21 and then, from upstream to downstream, the two stations 49 and 50. This machine can be combined with a device for preparing and transferring contents which are to be placed in the open box 1, the bottom 3 of which is formed and fastened, as well as a device for forming, closing and fastening the lid 4. Such a device may be of the abovementioned type, although it is not always essential given that the contents situated in the box 1 may themselves form the backing necessary for the application of the external flaps over the internal flaps.

As is described in the document U.S. Pat. No. 4,807,428, the various component elements of the machine may be mounted so as to slide but capable of being locked so as to enable the machine to be employed for boxes 1 of different formats.

In the alternative machine described in the document U.S. Pat. No. 4,807,428, the longitudinal vertical midplane of the machine permanently forms the longitudinal vertical plane of symmetry of the boxes 1. In this case, it is understood that the frame 34 is mounted so as to slide transversely relative to the frame 51 so as to be adapted to the format of the box 1 in the transverse direction. The frame 34 could, on the other hand, remain fixed relative to the frame 51 if the vertical and longitudinal reference plane of the boxes 1 were the reference plane P.

I claim:

1. In a method for forming, closing and reciprocally fastening the flaps of a box selected from a group of an American cardboard box, an American halfbox, a Dutch-box, and an equivalent box, the box comprising a pair of internal flaps situated on a side of an internal volume of the box and a pair of external flaps which cover the internal flaps, the method including the steps of bringing the internal flaps into their final position, depositing glue on fastening zones of the internal flaps, bringing the external flaps at least substantially into their final position with the glue fastening zones being in reciprocal contact and with facing free edges of the external flaps being spaced apart by a slot-shaped passage extending therebetween, then temporarily exerting a force on the two pairs of flaps, which force is appropriate to hold the flaps together and to maintain the fixed contact between the reciprocal fastening zones for a period required for an appropriate setting of the glue, the improvements comprising the step of temporarily exerting a force on the two pairs of flaps locking the flaps in their final position in order to prevent them from tending to return toward their initial position and being accomplished by applying a suction from the outside of the box through said slot-shaped passage limited by the two facing free edges of the pair of external flaps, said suction causing the internal flaps to be applied and held against the exterior flaps.

2. In a method according to claim 1, wherein the step of applying a suction includes providing a suction member and, when the external flaps are at least substantially in their final position, applying the suction member to the outer faces of the external flaps at least over the passage and facing the internal flaps when they are in their final position and, in this situation, activating the suction member so as to create a reduced pressure on a side of the outer faces of the internal flaps.

3. In a method according to claim 2, wherein said suction member has a suction zone and said method includes adjusting the suction zone in the longitudinal direction along the passage so as to enable forming, closing and fastening boxes of variable formats.

4. In a method according to claim 2, which includes displacing the suction member between a distal position where it is at a distance from a bottom or lid of the box, respectively, so as not to interfere with the flaps irrespective of their position and a proximal position where a suction zone of the suction member is substantially coplanar with a reference plane defined by the outer faces of the external flaps when they are in the final position.

5. In a method according to claim 4, which includes locking the suction member in the proximal position in order to at least contribute to insuring the locking of the pair of external flaps in the final position.

6. In a method according to claim 4, wherein the suction member is displaced so as to slide between the distal and proximal position along an axis extending perpendicular to the reference plane.

7. In a method according to claim 4, which includes activating the suction member only when the suction member is in the proximal position.

8. In a method according to claim 2, wherein the flaps of the box, as supplied, are substantially extensions of the side walls of the box, said step of bringing the pair of internal flaps includes folding the internal flaps toward the inside and their final position, said step of bringing the external flaps including folding the external flaps toward the inside and into contact with the internal flaps with the suction member being in a distal position to enable free movement of said external flaps, said suction member then being brought into a proximal position in contact with an outer surface of the external flaps, and being activated to apply a suction to temporarily exert the force for holding the flaps together as the glue sets, then, subsequent to the setting of the glue, said suction member being moved to the distal position and the box being removed.

9. In a method according to claim 8, wherein the step of folding the external flaps substantially to a final position includes providing arms for engaging the flaps as the arms are moved from an inactive distal position to an active proximal position.

10. In a method according to claim 9, wherein the arms are mounted for pivotal movement between the proximal and distal positions and the arms are maintained in the proximal position to ensure holding the flaps in their final position as the suction member is applied thereto.

11. In a method according claim 9, wherein the arms are moved from the proximal position to the inactive distal position at least simultaneously with movement of the suction member from its proximal position to the distal position.

12. A device for forming, closing and reciprocally fastening flaps of an American box, said device comprising box support and drive means for moving the box between various stations, first means including arms for bringing internal flaps of the box to at least substantially their final position, second means for applying glue to two fastening zones on the internal flaps, third means including movable arms for bringing the external flaps at least substantially into their final position and fourth means for temporarily exerting a force on the two pairs of flaps to hold the flaps together and to maintain the fixed contact between the reciprocal fastening zones for a period required for appropriate setting of the glue, said fourth means including a suction member being movable between a distal position and a proximal position, said suction member, in the proximal position, being capable of being activated and being situated in the vicinity of the third means and outside of the box, said suction member being connected to suction means for creating a reduced pressure so as to apply a suction through a gap between the facing free edges of the external flaps onto an external surface of the interior flaps.

13. A device according to claim 12, wherein the suction member is mounted for movement along an axis extending substantially perpendicular to a plane defined by the external flaps when in a final position.

14. A device according to claim 13, wherein the means for mounting the suction member for movement along said axis includes a jack attached to a frame of the device.

15. A device according to claim 12, which includes control means for switching the suction member between an active state and an inactive state.

16. A device according to claim 15, wherein the control means controls the suction member so that the suction member is only in an active state while in the proximal position.

17. In a device according to claim 12, wherein the suction member has the form of a hollow, rectangular section having a longitudinal front wall pierced with suction orifice defining a suction zone.

18. A device according to claim 17, wherein the suction means is carried by the frame and is connected to the hollow, rectangular section of the suction member by a flexible pipe.

19. A device according to claim 12, wherein the suction means consists of a device selected from a vacuum pump, a suction turbine, and a venturi device.

20. A device according to claim 12, wherein the arms of the third means comprise folding arms which can be moved between an inactive distal position and an active proximal position.

21. A device according to claim 20, wherein the folding arms are mounted so as to pivot about a longitudinal pivot spindle.

22. A device according to claim 20, wherein the folding arms have pressing, bent-back parts intended to be applied to an outer face of each of the flaps, when the flaps are in the final position, said pressing, bent-back parts defining, in an active proximal position of the arms, a reference plane.

23. A device according to claim 22, wherein an outer face of the pressing, bent-back parts of the folding arms in the active proximal position and a suction zone of the suction member in the proximal position are substantially coplanar.

24. A device according to claim 20, wherein a folding arm has a generally pseudo L shape comprising a main part forming a distance piece and supporting, at one of its ends, parts of a pressing, bent-back part and, at the other end, being inclined to the main part and curved inward and mounted so as to be pivotable on the frame of the device.

25. A device according to claim 24, wherein the pressing, bent-back part has a main part and at least one flange inclined to the main part and curved inward in the same relative direction as the main part of the folding arm.

26. A device according to claim 20, which includes two folding arms arranged opposite one another and having main parts being spaced apart from one another, inclined, inwardly-curved end parts being directed toward one another and having pressing, bent-back parts being substantially directed toward one another, and the other ends being pivoted to the frame adjacent each other, said two folding arms defining a central space in which the suction member and its support and drive means are at least partially housed.

27. A device according to claim 26, wherein the pressing, bent-back part has a flange and is reciprocally spaced apart, in particular in an active proximal position of the folding arms, so as to create between them a passage forming part of a space and in which the suction member can be housed and displaced.

28. A device according to claim 12, wherein a suction zone of the suction member can be adjusted in the longitudinal direction so that the device can form, close and fasten boxes of different formats with regard to a longitudinal direction.

29. A device according to claim 28, wherein the suction member is at least formed of two parts separated from one another and carried by separate support means which are mounted with a reciprocally longitudinal spacing which can be adjusted and locked in any particular position by way of a space adjusting means.

30. A device according to claim 29, wherein the two parts are carried by two arms mounted on a threaded shaft arranged so that the same direction of rotation of the shaft causes the arms to slide in two opposite directions to one another, said shaft including drive means for rotating the shaft.

31. A device according to claim 28, wherein the suction member is in at least two parts forming a unit which is telescopically slidable and can be adjusted and locked in any position by way of spacing adjustment means.

32. A device according to claim 28, wherein the suction member has a plurality of suction orifices extending along a line and placed one after another in said line, said suction member includes means for selectively activating some or all of said orifices.

33. A device according to claim 32, wherein the means for selectively activating the orifice comprises means for selectively opening and closing each of the orifices.

34. A device according to claim 32, wherein the means for selectively activating the orifices comprises means for selectively insuring the suction throughout the orifice.

35. A device according to claim 12, wherein the box support and drive means consist of a gripper conveyor arranged substantially horizontally and extending along a line in said device.

36. A device according to claim 35, wherein the suction member, the arms of the third means and and associated means are carried by the frame and situated completely on the same side of the conveyor.

37. A device according to claim 36, wherein the third means and the suction member are fixed relative to the conveyor in a transverse direction.

38. A device according to claim 36, wherein the third means and the suction member, as a whole, are mounted so as to slide relative to the conveyor in a transverse direction.

39. A device according to claim 12, wherein the box support and drive means has a conveyor having at least two successive separate stations therealong with an upstream station comprising the first means for bringing the internal flaps at least substantially into their final position and the second means for gluing, and the downstream station consisting of the third means for bringing the external flap and the fourth means for temporarily exerting a force on the two pairs of flaps.

40. A device according to claim 12, wherein the device is a boxing machine having a frame, a storage for box blanks folded flat and stacked, means for transferring a blank from the storage means into a gripper conveyor of a box support and drive means and, subsequent to the fourth means, means for placing contents into the box.

41. In a method according to claim 2, which includes deactivating the suction member so that the suction has no effect.

* * * * *